US005832593A

United States Patent [19]

Wurst et al.

[11] Patent Number: 5,832,593

[45] Date of Patent: Nov. 10, 1998

[54] SPLICE HEAD FOR INSULATED TELECOMMUNICATION WIRES

[75] Inventors: Wolfgang Wurst; Udo Seidel, both of Hamburg, Germany

[73] Assignee: Minnesota Mining and Manufacturing Company, St. Paul, Minn.

[21] Appl. No.: 840,532

[22] Filed: Apr. 22, 1997

Related U.S. Application Data

[63] Continuation of Ser. No. 356,164, filed as PCT/US94/02739 Mar. 14, 1994, abandoned.

[30] Foreign Application Priority Data

Apr. 14, 1993 [DE] Germany ..... 9305605 U

[51] Int. Cl.[6] ..... H01R 43/22; H01R 43/28

[52] U.S. Cl. ..... 29/750; 29/33 M; 29/749; 29/755; 29/758; 29/760

[58] Field of Search ..... 29/33 M, 747, 29/748, 749, 750, 755, 758, 760; 269/903

[56] References Cited

U.S. PATENT DOCUMENTS

| | | | |
|---|---|---|---|
| 3,713,214 | 1/1973 | Enright et al. | 29/755 X |
| 3,803,695 | 4/1974 | Tucci | 29/749 |
| 4,095,336 | 6/1978 | Throne | 29/749 |
| 4,110,896 | 9/1978 | Roiko | 29/749 X |
| 4,282,644 | 8/1981 | Petree | 29/566.3 |
| 4,446,617 | 5/1984 | Lydell, et al. | 29/749 X |
| 4,551,893 | 11/1985 | Ikeda et al. | 29/33 M |
| 4,825,530 | 5/1989 | Komuro | 29/749 X |
| 5,174,781 | 12/1992 | Hockaday et al. | 385/49 |
| 5,231,683 | 7/1993 | Hockaday et al. | 385/49 |

FOREIGN PATENT DOCUMENTS

| | | | |
|---|---|---|---|
| 0 560 043 A2 | 8/1996 | European Pat. Off. | G02B 6/12 |
| 3920367 A1 | 1/1991 | Germany | H01R 9/07 |
| 2108017 | 5/1988 | United Kingdom | 29/749 |
| WO 93/21550 | 10/1993 | WIPO | G02B 6/30 |

*Primary Examiner*—Peter Vo
*Attorney, Agent, or Firm*—Gerald F. Chernivec

[57] ABSTRACT

A splice head for use with a modular wire connector, to work with and hold the wires while installing them in the connector, particularly for wires of differing diameters. The splice head includes a coil spring loosely arranged on a bar and movable axially thereon. By selecting an appropriate location for the starting point on the spring and selection of the spring position on the bar, different sized wires can be fixed by the coils of the spring. The bar may be circular in cross-section to allow the spring to slide easily forward and backward. This construction allows simpler placement of the wires since the coil spring does not need to to replaced for wires of different sizes, and there is no requirement that the splicing operation begin at one particular end of the coil since neither end is fixed.

11 Claims, 2 Drawing Sheets

SPLICE HEAD FOR INSULATED TELECOMMUNICATION WIRES

This is a continuation of application Ser. No. 08/356,164, filed Dec. 19, 1994, now abandoned.

BACKGROUND OF THE INVENTION

1. Field of the Invention

The invention refers to a splice head for insulated wires of the type used by the telecommunication industry.

2. Prior Art

Connectors for the telecommunication industry are know wherein a plurality of insulated wires are connected with electrical contacts. From the German patent DE 39 20 362 it has become known to provide a retaining body with a plurality of insulation displacing contact elements and to have the wires engaged with the contact elements by means of a pressing body so that the contact elements coact with the associated wires while piercing through the insulation thereof. The pressing body includes recesses or pockets into which the free ends of the cutting contact elements are plunged. Further, cutting elements are located in the retaining body which cut the projecting ends of the connected insulated wires.

In order to align the insulated wires with respect to the retaining body it has also become known to employ a splice head. The splice head comprises accommodation means for a connector, i.e. at least one retaining body and at least one pressing body. It further includes a row of spaced separating fingers on one side of the accommodation means. Such a splice head is associated with the end of a cable or wire bundle, with the individual cores or wires exposed. The wires are arranged in the slots between the fingers and aligned with the individual insulation displacement contacts of the retaining body. The ends of the insulated wires extending beyond the accommodation means are fixed in a suitable manner until the all of wires has been laid onto the connector. Thereafter, the pressing body is pressed against the retaining body, preferably by a suitable tool, in order to concurrently bring the insulated wires in engagement with the insulation displacing contacts.

It has become known to use a coil spring for fixing the loose ends of the wires in the splice head. The insulated wires are inserted between the coils or convolutions of the spring and retained therein by spring forces. It has become known to use a single coil spring which is supported on a step of the splice head. A retaining bar is extended through the interior of the spring and fastened at both ends to the splice head. The known springs have a diameter of approximately 10 mm, with the convolutions thereof leaving a predetermined space therebetween. The spring has, at least at one end, a piece bent to project radially in order to fasten the spring at one end against axial movement. If upon a splicing operation a plurality of wires is introduced between the convolutions of the spring, the free end thereof moves axially away from the stationary first end.

When establishing such connections, the diameter of the insulated wires may be within a larger range. On known splice heads, particularly, the coil springs are not suited to effectively fix wires of different diameters. Therefore, it is required to replace the springs in case of wires having different diameters. The spring is fixed at one end, therefore, the splicing operation has to be always started at this end of the spring.

In connection with splice heads it has also become known to use two parallel coil springs having different spaces between their convolutions in order to effectively fix wires of different diameters. If, however, during a splicing operation wires are to be inserted into the spring which have another diameter, it is necessary to untighten the retaining means for both coil springs and to turn the coil springs about 180° and then to retighten the retaining means. This measure is relatively time consuming. By the way, both springs are fastened at both ends. In case of tolerances in the distance between the fastening locations of the springs, the space between the individual convolutions may be changed. Further, the known springs are not suited to accommodate more than one wire between adjacent convolutions. This is disadvantageous if in a connector arrangement a plurality of layers of wires are to be contacted by the connector arrangement.

SUMMARY OF THE INVENTION

The invention provides a splice head for insulated wires, particularly for telecommunications, which is designed to work with and hold wires with different diameters.

In the splice head according to the invention, the coil spring is loosely arranged on the bar and may be moved axially. By the free selection of the starting point at the spring for the splicing operation and the free selection of the spring position on the bar, different sized wires can be fixed by the coils of the spring. Further, the splicing can be started contemporarenously at both ends of the spring.

According to an embodiment of the invention, the bar may have a circular cross section so that the spring may slide easily forward and backward.

According to a further embodiment of the invention, an engaging surface is provided somewhat below the bar and is spaced a small distance therefrom which engaging surface is adapted to support the circumference of the spring while it is retained by the bar interiorly. The space between the engaging surface and the bar is somewhat larger that the diameter or thickness of the wire forming the coil spring. By this measure, maximum space is left for the accommodation of the insulated wires so that two or more wires can be inserted between adjacent coils. This would be further improved if according to a further embodiment of the invention the diameter of the coil spring is larger than 12 mm, preferably 15 mm.

For an effective support of the coil spring and a most effective cross-sectional area for the fixing of the wires the engaging surface is formed and provides a space with respect to the bar such that in the operational position of the spring the bar engages the spring approximately at the level of the longitudinal axis of the spring. Preferably, the engaging surface extends partially circularly about the bar.

The bar can be retained by a U-shaped retaining member which according to an embodiment of the invention integrally includes the engaging surface.

With the splice head according to the invention, the coil spring need not be replaced in order to fix wires of different diameter sizes. Since the coil spring is loosely arranged on the bar, radial bends at the ends of the spring could be omitted. This facilitates the manufacturing of the coil spring.

The invention will be subsequently described by means of an embodiment described in connection with the accompanying drawing.

DETAILED DESCRIPTION OF THE PRESENTLY PREFERRED EMBODIMENT

Figure 1:
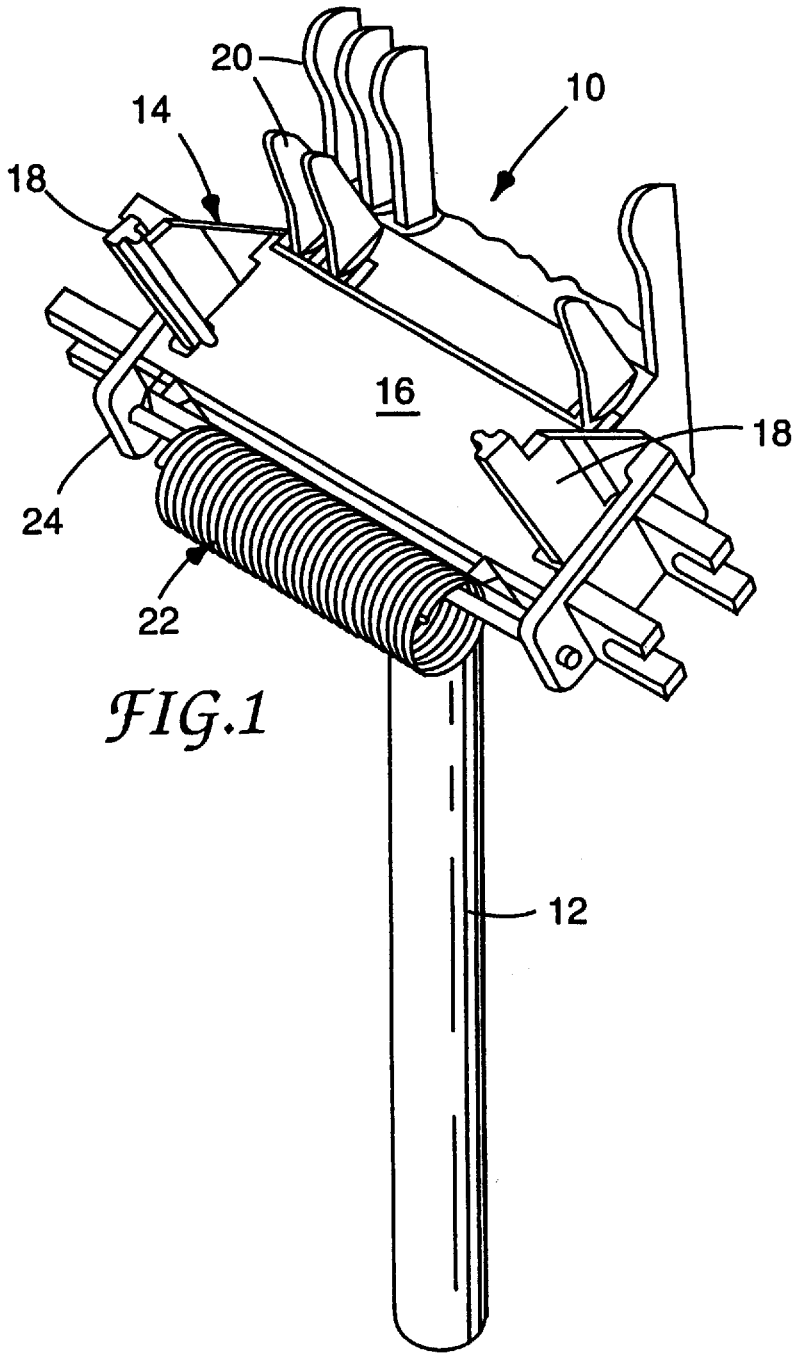
FIG. 1 is a diagrammatic view of a splice head according to the invention.

In FIG. 1, a splice head 10 is shown retained by retaining means 12 adapted to be manually held or fixed by known fastening means. The splice head 10 includes an accommodation means 14 for supporting a connector, not shown, adapted to receive a plurality of insulated wires. Such a connector is for example disclosed by the DE 39 20 367. The accommodation means 14 comprises a support plate 16 and two lateral guide elements 18 to keep a connector therebetween which includes at least a retaining body and a pressing body. Two rows of fingers 20 are located on one side of the accommodation means 14. Insulated wires may be extended therebetween and separated from each other. A coil spring 22 is located on the opposite side of the plate 16 of the accommodation means. The coil spring 22 is retained by retaining means 24. Details of the retaining means and of the coil spring are illustrated in FIGS. 2 to 5.

The retaining means 24 consists of a U-shaped retaining member 26, with the legs thereof retaining a bar 28 of circular cross section. The bar 28 is fitted through holes in the legs accommodating said bar or a slot in the retaining means 24 and legs. As can be seen, coil spring 22 has a length smaller than the length between the legs or the length of bar 28. Therefore, the coil spring 22 can be freely moved along bar 28. The diameter of spring 22 is for example 15 mm, and the thickness or diameter of the wire forming the coil spring 22 is larger than 1.2 mm, for example 1.5 mm. The individual coils 30 or convolutions of spring 22 have a predetermined space therebetween. As can be seen from FIGS. 2 to 4, the ends of the wire forming the coil spring are simply cut and not deformed in a particular manner.

Figure 5:
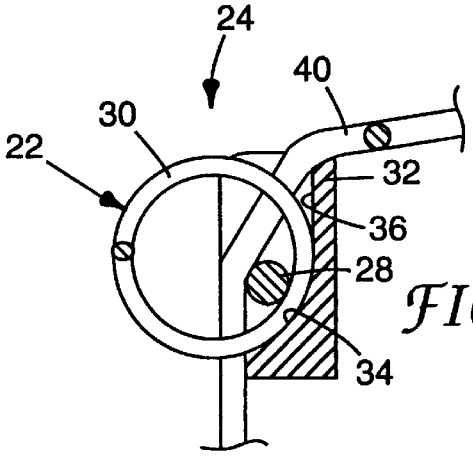
FIG. 5 is a cross sectional view through a coil spring of FIG. 2 along line 5—5.

From FIG. 5 it can be seen that an arcuate engaging surface 34, circular in cross section, is formed in the web 32 of the U-shaped retaining member 26. The most narrow space between bar 28 and engaging surface 34 is slightly larger than the thickness of the spring wire. The circular engaging surface 34 extends into or joins with an upper planar surface 36 which would extend parallel to a plane through the axis of coil spring 22. The normal distance between surface 36 and bar 28 is larger then the space between engaging surface 34 and bar 28. As can be seen further, engaging surface 34 is formed and located relatively to bar 28 such that bar 28 engages spring 22 approximately at the level of the longitudinal axis of spring 22 when the spring 22 is in its operational position.

Figure 2:
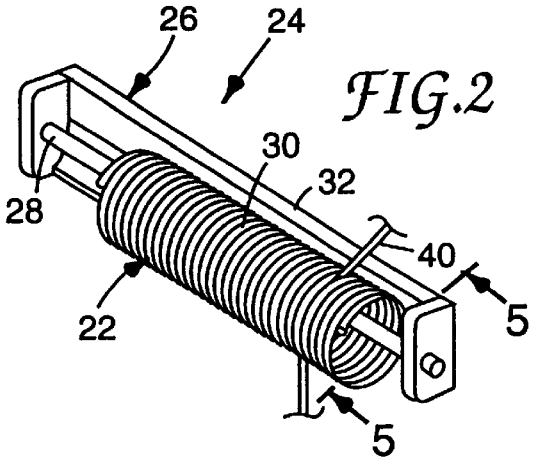
FIGS. 2 to 4 illustrate the coil spring of the splice head of FIG. 1 in different operational positions.
Figure 3:
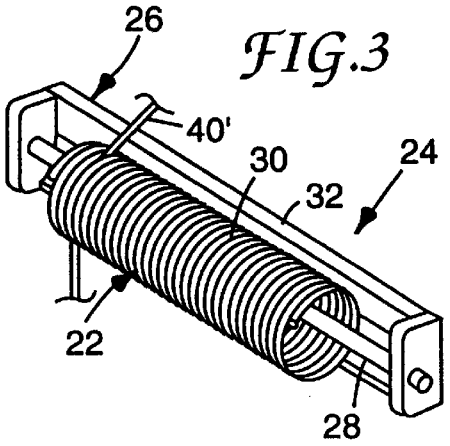
Figure 4:
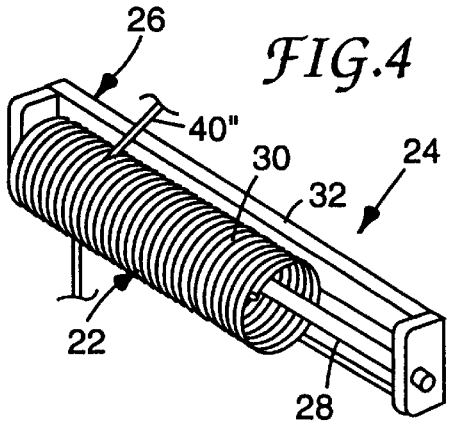

In FIGS. 2 to 5 it is illustrated how wires 40, 40', 40", respectively, are inserted into and fixed by spring 22. FIGS. 2 to 4 make clear that the start of the splicing operation can be selected arbitrarily in that the spring 22 may occupy an arbitrary position between the legs of the U-shaped retaining member 26 at the beginning of the splicing operation.

It will be clear from FIG. 5 that apart from the diameter of bar 28, the largest part of the cross section of spring 22 is available for the fixing of wire 40, 40' or 40", respectively, so that also two or more wires may be inserted between adjacent helical convolutions or coils 30.

We claim:

1. A splice head for interconnecting a plurality of insulated wires (40, 40', 40") to a connector, said splice head comprising accommodation means (14) for supporting a connector to be interconnected to said insulated wires, a row of spaced separating fingers (20) on one side of said accommodation means (14), a length of coil spring (22) on the opposite side of said accommodation means, with the coils (30) of said coil spring (22) affording insertion and fixation of wires therebetween, and retaining means (26) for said coil spring (22), said retaining means being connected to said accommodation means, said retaining means comprising a bar (28) extending through said coil spring (22) which bar (28) is fastened at both ends to said retaining means, said coil spring (22) is loosely and axially movably arranged on said bar so that said coil spring may be positioned alone the bar from one of said ends to the other of said ends, as well as any position between said ends.

2. The splice head of claim 1, wherein said bar (28) is attached to the legs of a U-shaped retaining member (26).

3. The splice head of claim 1, wherein said retaining means includes an engaging surface (34) below said bar (28) and spaced a small distance from said bar, with the external surface of the coil spring (22) supported by said engaging surface (34), the coil spring (22) being held internally by said bar.

4. The splice head of claim 3, wherein said engaging surface (34) is concave and extends partially about the outer periphery of said coil spring (22).

5. The splice head of claim 3, wherein said coils (30) of said coil spring (22) have a predetermined space from each other for the insertion of the wires.

6. The splice head of claim 3, wherein said engaging surface (34) is concave and extends partially about the outer periphery of said coil spring (22).

7. The splice head of claim 6, wherein said engaging surface (34) extends into an upper planar surface (36), there being a first distance between said planar surface (36) and said bar (28) and a second distance between said engaging surface (34) and said bar (28), said first distance being larger than said second distance.

8. The splice head of claim 1, wherein said engaging surface (34) is integrally formed on the web (32) of said U-shaped retaining member (26).

9. A splice head for interconnecting a plurality of insulated wires (40, 40', 40") to a connector, said splice head comprising accommodation means (14) for supporting a connector to be interconnected to said insulated wires, a row of spaced separating fingers (20) on one side of said accommodation means (14), a length of coil spring (22) on the opposite side of said accommodation means, with the coils (30) of said coil spring (22) affording insertion and fixation of wires therebetween, and retaining means (26) for said coil spring (22), said retaining means being connected to said accommodation means, said retaining means comprising a bar (28) extending through said coil spring (22) which bar (28) is fastened at both ends to said retaining means, said coil spring (22) is loosely and axially movably arranged on said bar, wherein said bar (28) has a circular cross section.

10. A splice head for interconnecting a plurality of insulated wire (40, 40', 40") to a connector, said splice head comprising accommodation means (14) for supporting a connector to be interconnected to said insulated wires, a row of spaced separating fingers (20) on one side of said accommodation means (14), a length of coil spring (22) on the opposite side of said accommodation means, with the coils (30) of said coil spring (22) affording insertion and fixation of wires therebetween, and retaining means (26) for said coil spring (22), said retaining means being connected to said accommodation means, said retaining means comprising a bar (28) extending through said coil spring (22) which bar (28) is fastened at both ends to said retaining means, said coil spring (22) is smaller than said bar and is loosely and axially movably arranged on said bar, wherein the diameter of a coil spring (22) is larger than 12 mm.

11. A splice head for interconnecting a plurality of insulated wires (40, 40', 40") to a connector, said splice head comprising accommodation means (14) for supporting a connector adapted to be interconnected said to insulated wires, a row of spaced separating fingers (20) on one side of said accommodation means (14), at length of coil spring (22) on the opposite side of said accommodation means, with the coils (30) of said coil spring (22) affording insertion and fixation of wires therebetween, and retaining means (26) for said coil spring (22), said retaining means being connected to said accommodation means, said retaining means comprising a bar (28) extending through said coil spring (22) which bar (28) is fastened at both ends to said retaining means, said coil spring (22) is loosely and axially movably arranged on said bar, wherein the thickness of the spring wire forming the coil spring (22) is larger than 1.2 mm.

* * * * *